US010882715B2

(12) United States Patent
Pamperin et al.

(10) Patent No.: US 10,882,715 B2
(45) Date of Patent: Jan. 5, 2021

(54) METHOD AND SYSTEM FOR SPLICING NOSE WIRE IN A FACEMASK MANUFACTURING PROCESS

(71) Applicant: O&M Halyard, Inc., Mechanicsville, VA (US)

(72) Inventors: Mark Thomas Pamperin, Cumming, GA (US); Nathan Craig Harris, Canton, GA (US); Joseph P. Weber, Suwanee, GA (US); Ajay Y. Houde, Johns Creek, GA (US); David Lamar Harrington, Cumming, GA (US)

(73) Assignee: O&M Halyard, Inc., Mechanicsville, VA (US)

( * ) Notice: Subject to any disclaimer, the term of this patent is extended or adjusted under 35 U.S.C. 154(b) by 283 days.

(21) Appl. No.: 15/768,105

(22) PCT Filed: Oct. 16, 2015

(86) PCT No.: PCT/US2015/055858
§ 371 (c)(1),
(2) Date: Aug. 21, 2018

(87) PCT Pub. No.: WO2017/065783
PCT Pub. Date: Apr. 20, 2017

(65) Prior Publication Data
US 2018/0354743 A1 Dec. 13, 2018

(51) Int. Cl.
*B65H 69/06* (2006.01)
*A62B 23/02* (2006.01)
*B65H 69/00* (2006.01)

(52) U.S. Cl.
CPC ..... *B65H 69/06* (2013.01); *A62B 23/025* (2013.01); *B65H 69/00* (2013.01); *B65H 2701/36* (2013.01)

(58) Field of Classification Search
CPC .... B65H 69/06; B65H 69/00; B65H 2701/36; A62B 23/025; A41D 13/1123;
(Continued)

(56) References Cited

U.S. PATENT DOCUMENTS 2,354,294 A 7/1944 Schimmel
3,123,125 A * 3/1964 Lacey, Jr. ..... B21D 13/02 72/307
(Continued)

FOREIGN PATENT DOCUMENTS

CA 828007 A 11/1969
CA 2 325 975 A1 5/2002
(Continued)

OTHER PUBLICATIONS

International Search Report and Written Opinion for PCT/US2015/055858, dated Jun. 22, 2016, 13 pages.

*Primary Examiner* — Lee A Holly
(74) *Attorney, Agent, or Firm* — Dority & Manning, P.A.

(57) ABSTRACT

A method and system are provided for splicing a reserve nose wire to a running nose wire in a facemask production line. Prior to depletion of the running nose wire, a reserve nose wire is brought up to a transport speed in a conveying direction of the running nose wire. At or near a zero relative speed between the running nose wire and the reserve nose wire, a leading end of the reserve nose wire is introduced onto the running nose wire, and the two wires are spliced together. The running nose wire is then cut upstream of the splice location such that the reserve nose wire becomes a new running nose wire in the production line.

9 Claims, 4 Drawing Sheets

(58) Field of Classification Search
CPC ..... A41D 13/1107; A41D 13/1161; B21C 37/08; B21D 13/02
See application file for complete search history.

(56) References Cited

U.S. PATENT DOCUMENTS

| | | | | |
|---|---|---|---|---|
| 3,242,783 | A | 3/1966 | Schmermund | |
| 3,670,474 | A | 6/1972 | Vieson et al. | |
| 3,800,640 | A | 4/1974 | Barrie | |
| 3,847,046 | A | 11/1974 | Schmermund | |
| 3,926,097 | A | 12/1975 | Santa Maria et al. | |
| 3,958,390 | A | 5/1976 | Pringle, Jr. et al. | |
| 3,971,369 | A | 7/1976 | Aspelin et al. | |
| 3,983,774 | A | 10/1976 | Seragnoli | |
| 4,261,457 | A | 4/1981 | van Maanen | |
| 4,269,315 | A | 5/1981 | Boyce | |
| 4,440,289 | A | 4/1984 | Weis | |
| 4,467,589 | A | 8/1984 | van Maanen | |
| 4,525,977 | A | 7/1985 | Matt | |
| 4,543,152 | A | 9/1985 | Nozaka | |
| 4,549,386 | A | 10/1985 | Wilson | |
| 4,550,856 | A | 11/1985 | Ballmann et al. | |
| 4,630,310 | A | 12/1986 | Winesett | |
| 4,662,005 | A | 5/1987 | Grier-Idris | |
| 4,722,168 | A | 2/1988 | Heaney | |
| 4,809,481 | A | 3/1989 | Früh et al. | |
| 5,079,902 | A | 1/1992 | Seko et al. | |
| 5,117,614 | A | 6/1992 | Johnsen | |
| 5,155,967 | A | 10/1992 | Branson | |
| 5,170,610 | A | 12/1992 | Tisma | |
| 5,322,061 | A | 6/1994 | Brunson | |
| 5,548,946 | A | 8/1996 | Holub | |
| 5,615,767 | A | 4/1997 | Eull et al. | |
| 5,724,677 | A | 3/1998 | Bryant et al. | |
| 5,727,369 | A | 3/1998 | Mosse | |
| 5,921,375 | A | 7/1999 | Van Laar | |
| 6,098,785 | A | 8/2000 | Van Maanen | |
| 6,117,515 | A | 9/2000 | Brunson et al. | |
| 6,122,898 | A | 9/2000 | De Kort | |
| 6,123,077 | A | 9/2000 | Bostock et al. | |
| 6,125,849 | A * | 10/2000 | Williams ..... | A62B 23/025 128/206.12 |
| 6,173,712 | B1 | 1/2001 | Brunson | |
| 6,174,397 | B1 | 1/2001 | Johnson | |
| 6,394,090 | B1 | 5/2002 | Chen et al. | |
| 6,524,423 | B1 | 2/2003 | Hilt et al. | |
| 6,729,103 | B1 | 5/2004 | Hartness et al. | |
| 6,868,984 | B2 | 3/2005 | Griesbach, III et al. | |
| 6,886,563 | B2 | 5/2005 | Bostock et al. | |
| 7,703,260 | B1 | 4/2010 | Watkins | |
| 8,061,356 | B2 * | 11/2011 | Bowen ..... | A41D 13/1107 128/206.12 |
| 8,700,214 | B2 | 4/2014 | Fortman | |
| 10,227,202 | B2 | 3/2019 | Pamperin et al. | |
| 10,492,547 | B2 | 12/2019 | Weber et al. | |
| 2002/0095913 | A1 | 7/2002 | Honegger | |
| 2003/0000805 | A1 | 1/2003 | Wild et al. | |
| 2003/0010422 | A1 | 1/2003 | Starkey | |
| 2004/0121107 | A1 | 6/2004 | Bell et al. | |
| 2004/0144619 | A1 | 7/2004 | Ohiro et al. | |
| 2004/0262127 | A1 | 12/2004 | Harnish et al. | |
| 2005/0166733 | A1 | 8/2005 | Piscitello | |
| 2006/0070353 | A1 | 4/2006 | Van Dam | |
| 2008/0072721 | A1 | 3/2008 | Kern | |
| 2008/0251210 | A1 | 10/2008 | Chen | |

FOREIGN PATENT DOCUMENTS

| | | | |
|---|---|---|---|
| CN | 104872866 | A | 9/2015 |
| CN | 104939377 | A | 9/2015 |
| DE | 3736868 | A1 | 5/1989 |
| EP | 0 257 852 | A2 | 3/1988 |
| EP | 0 622 298 | A1 | 11/1994 |
| EP | 0 640 526 | A1 | 3/1995 |
| EP | 0 791 537 | A1 | 8/1997 |
| EP | 0 806 343 | A2 | 11/1997 |
| EP | 0 894 752 | A1 | 2/1999 |
| EP | 1 048 595 | A1 | 11/2000 |
| EP | 1 757 552 | A2 | 2/2007 |
| EP | 1 840 033 | A2 | 10/2007 |
| EP | 2 484 611 | A2 | 8/2012 |
| EP | 2 757 062 | A1 | 7/2014 |
| EP | 2 801 790 | A1 | 11/2014 |
| FR | 1 588 621 | | 4/1970 |
| GB | 364557 | | 12/1931 |
| GB | 1 216 310 | | 12/1970 |
| GB | 1 232 053 | | 5/1971 |
| GB | 1 361 496 | | 7/1974 |
| GB | 2 092 090 | A | 8/1982 |
| JP | S 62103536 | U | 7/1987 |
| JP | H04311405 | A | 11/1992 |
| JP | H05-78007 | A | 3/1993 |
| JP | H05170209 | A | 7/1993 |
| JP | H06211214 | A | 8/1994 |
| JP | 2000198600 | A | 7/2000 |
| JP | 2002052487 | A | 2/2002 |
| JP | 2005272512 | A | 10/2005 |
| JP | 2007084309 | A | 4/2007 |
| JP | 2008055035 | A | 3/2008 |
| JP | 2009286490 | A | 12/2009 |
| JP | 2011178459 | A | 9/2011 |
| JP | 2011200510 | A | 10/2011 |
| JP | 2012201409 | A | 10/2012 |
| JP | 2013230380 | A | 11/2013 |
| KR | 100550225 | B1 | 2/2006 |
| WO | WO 97/32494 | | 9/1997 |
| WO | WO 99/24119 | A1 | 5/1999 |
| WO | WO 02/28760 | A1 | 4/2002 |
| WO | WO 2005/054106 | A1 | 6/2005 |

* cited by examiner

-Prior Art-

-Prior Art-

-Prior Art-

METHOD AND SYSTEM FOR SPLICING NOSE WIRE IN A FACEMASK MANUFACTURING PROCESS

FIELD OF THE INVENTION

The present invention relates generally to the field of protective facemasks, and more specifically to a method and system for splicing nose wire supplies in the manufacturing line of such facemasks.

FAMILY OF RELATED APPLICATIONS

The present application is related by subject matter to the following concurrently filed PCT applications (all of which designate the US):

International Application No.: PCT/US2015/055858; entitled "Method and System for Splicing Nose Wire in a Facemask Manufacturing Process".

a. International Application No.: PCT/US2015/055861; entitled "Method and System for Splicing Nose Wire in a Facemask Manufacturing Process".

b. International Application No.: PCT/US2015/055863; entitled "Method and System for Introducing a Reserve Nose Wire in a Facemask Production Line".

c. International Application No.: PCT/US2015/055865; entitled "Method and System for Cutting and Placing Nose Wires in a Facemask Manufacturing Process".

d. International Application No.: PCT/US2015/055867; entitled "Method and System for Placing Nose Wires in a Facemask Manufacturing Process".

e. International Application No.: PCT/US2015/055871; entitled "Method and System for Placing Nose Wires in a Facemask Manufacturing Process".

f. International Application No.: PCT/US2015/055872; entitled "Method and System for Placing Nose Wires in a Facemask Manufacturing Process".

g. International Application No.: PCT/US2015/055876; entitled "Method and System for Wrapping and Preparing Facemasks for Packaging in a Facemask Manufacturing Line".

h. International Application No.: PCT/US2015/055878; entitled "Method and System for Automated Stacking and Loading Wrapped Facemasks into a Carton in a Facemask Manufacturing Line".

i. International Application No.: PCT/US2015/055882; entitled "Method and System for Automated Stacking and Loading of Wrapped Facemasks into a Carton in a Facemask Manufacturing Line".

The above cited applications are incorporated herein by reference for all purposes. Any combination of the features and aspects of the subject matter described in the cited applications may be combined with embodiments of the present application to yield still further embodiments of the present invention.

BACKGROUND OF THE INVENTION

Various configurations of disposable filtering facemasks or respirators are known and may be referred to by various names, including "facemasks", "respirators", "filtering face respirators", and so forth. For purposes of this disclosure, such devices are referred to generically as "facemasks."

The ability to supply aid workers, rescue personnel, and the general populace with protective facemasks during times of natural disasters or other catastrophic events is crucial. For example, in the event of a pandemic, the use of facemasks that offer filtered breathing is a key aspect of the response and recovery to such event. For this reason, governments and other municipalities generally maintain a ready stockpile of the facemasks for immediate emergency use. However, the facemasks have a defined shelf life, and the stockpile must be continuously monitored for expiration and replenishing. This is an extremely expensive undertaking.

Recently, investigation has been initiated into whether or not it would be feasible to mass produce facemasks on an "as needed" basis during pandemics or other disasters instead of relying on stockpiles. For example, in 2013, the Biomedical Advanced Research and Development Authority (BARDA) within the Office of the Assistant Secretary for Preparedness and Response in the U.S. Department of Health and Human Services estimated that up to 100 million facemasks would be needed during a pandemic situation in the U.S., and proposed research into whether this demand could be met by mass production of from 1.5 to 2 million facemasks per day to avoid stockpiling. This translates to about 1,500 masks/minute. Current facemask production lines are capable of producing only about 100 masks/minute due to technology and equipment restraints, which falls far short of the estimated goal. Accordingly, advancements in the manufacturing and production processes will be needed if the goal of "on demand" facemasks during a pandemic is to become a reality.

The various configurations of filtration facemasks include a flexible, malleable metal piece, known as "nose wire", along the edge of the upper filtration panel to help conform the facemask to the user's nose and retain the facemask in place during use, as is well known. The nose wire may have a varying length and width between different sizes and mask configurations, but is generally cut from a spool and encapsulated or sealed in nonwoven material layers during the in-line manufacturing process. For mass production at the throughputs mentioned above, as the spool is depleted, it will be necessary to splice a reserve spool into the running line while maintaining the high production speeds of the running line.

The present invention addresses this need and provides a method and related system for high speed splicing of a nose wire into a running in-line production of facemasks.

SUMMARY OF THE INVENTION

Objects and advantages of the invention will be set forth in the following description, or may be obvious from the description, or may be learned through practice of the invention.

In accordance with aspects of the invention, a method is provided for splicing a reserve nose wire to a running nose wire in a facemask production line, wherein the splicing operation does not necessitate a stoppage or slowdown of consequence in the production line. It should be appreciated that the present inventive method is not limited to any particular style or configuration of facemask that incorporates a nose wire, or to the downstream facemask production steps.

The method includes, prior to depletion of the running nose wire, bringing the reserve nose wire up to a transport speed in a conveying direction of the running nose wire. The transport speed is such that a relative speed of at or near a zero is established between the running nose wire and the reserve nose wire. It should be appreciated that "at or near zero" is intended to encompass some degree of speed deviation so long as such deviation does not prevent a subsequent splicing of the reserve nose wire to the running nose wire. Although a zero relative speed between the wires may be preferred, the invention encompasses a speed deviation that is "near zero" and essentially dictated by the degree of speed difference that can be tolerated in the subsequent splicing process. At the desired relative speed of at or near zero, a leading end of the reserve nose wire is introduced onto the running nose wire. The two nose wires are then spliced together. The running nose wire is then cut at a downstream cutting location such that the reserve nose wire becomes a new running nose wire in the production line.

Various means may be employed for splicing the reserve nose wire to the running nose wire, including adhesive application, spot tacking, and so forth. In a certain embodiment, the splicing process is performed by crimping the reserve nose wire onto the running nose wire with a crimper and a clip.

The reserve nose wire is supplied from any suitable supply configuration, such as loops or folds of the reserve wire. In a particular embodiment, the reserve nose wire is supplied from a reserve roll or spool (referred to generically as a "roll"), and a leading end of the reserve nose wire is drawn off of the roll and staged at a location for subsequent feeding onto the running nose wire at or near the zero relative speed. With this embodiment, one or more positively-driven and separately controlled feed rollers may be used to draw the leading end of the reserve nose wire from the reserve roll and onto the running nose wire.

It may be desired to create an initial accumulation of the reserve nose wire from the roll by driving the reserve roll prior to engaging the feed rollers. In this manner, the feed rollers can engage and accelerate the reserve nose wire up to the transport speed of the running nose wire relatively quickly without having to accelerate the entire reserve roll. The reserve roll can come up to operational rotational speed as the accumulation length of wire is being depleted.

It is important during formation of the accumulation that the nose wire is not allowed to kink or twist. In this regard, a guide may be used during formation of the accumulation to prevent such kinking or twisting. This guide may be movable relative to the reserve roll to allow the accumulation to grow or expand without folding over, which minimizes the possibility of twisting or kinking or the wire.

After the splicing process, the reserve roll can be moved to an in-line operating position after the splice, and a new reserve roll can be staged for a subsequent splice operation. Alternately, the reserve roll can become the operational roll without being relocated, and the new reserve roll can be staged at the location of the previous running roll.

In one embodiment, the splice is performed with a portable splice cabinet that is brought into position alongside of the production line and functionally between the reserve roll and the running nose wire. After the splice is complete, the splice cabinet can be functionally disengaged from the production line and moved to another location or different production line. In an alternative embodiment, the splice is performed by splice machinery that is permanently configured with the production line.

Various controls may be utilized to accomplish the splicing process. For example, in one particular method, the transport speed of the running nose wire is sensed and, based on this running speed and a distance of the leading end of the reserve wire from a splicing location, the reserve nose wire can be brought up to the transport speed to achieve the at or near zero relative speed between the reserve nose wire and the running nose wire necessary for the splice.

In order to properly time the splice, certain embodiments may include sensing a depletion state of the running nose wire and timing the splicing as a function of the sensed depletion state. For example, at a given sensed diameter of a roll of the running nose wire, the splice sequence can be initiated. The present invention also encompasses various system embodiments for splicing a reserve nose wire to a running nose wire in a facemask production line in accordance with the present methods, as described and supported herein.

Other features and aspects of the present invention are discussed in greater detail below.

BRIEF DESCRIPTION OF THE DRAWINGS

A full and enabling disclosure of the present invention, including the best mode thereof, directed to one of ordinary skill in the art, is set forth more particularly in the remainder of the specification, which makes reference to the appended figures in which.

DETAILED DESCRIPTION OF REPRESENTATIVE EMBODIMENTS

Reference now will be made in detail to various embodiments of the invention, one or more examples of which are set forth below. Each example is provided by way of explanation of the invention, not limitation of the invention. In fact, it will be apparent to those skilled in the art that various modifications and variations may be made in the present invention without departing from the scope or spirit of the invention. For instance, features illustrated or described as part of one embodiment, may be used on another embodiment to yield a still further embodiment. Thus, it is intended that the present invention covers such modifications and variations as come within the scope of the appended claims and their equivalents.

As mentioned, the present methods relate to splicing of a reserve nose wire to a running nose wire in a facemask production line. The downstream facemask production steps are not limiting aspects of the invention and, thus, will not be explained in great detail herein.

Also, the present disclosure refers to or implies conveyance or transport of certain components of the facemasks through the production line. It should be readily appreciated that any manner and combination of article conveyors (e.g., rotary and linear conveyors), article placers (e.g. vacuum puck placers), and transfer devices are well known in the article conveying industry and can be used for the purposes described herein. It is not necessary for an understanding and appreciation of the present methods to provide a detailed explanation of these well-known devices and system.

Various styles and configurations of facemasks that incorporate a nose wire are well known, including flat pleated facemasks, and the present methods may have utility in the production lines for these conventional masks. For illustrative purposes only, aspects of the present method are described herein with reference to a particular type of respirator facemask often referred to in the art as a "duckbill" mask, as illustrated in FIG. 1.

Figure 1:
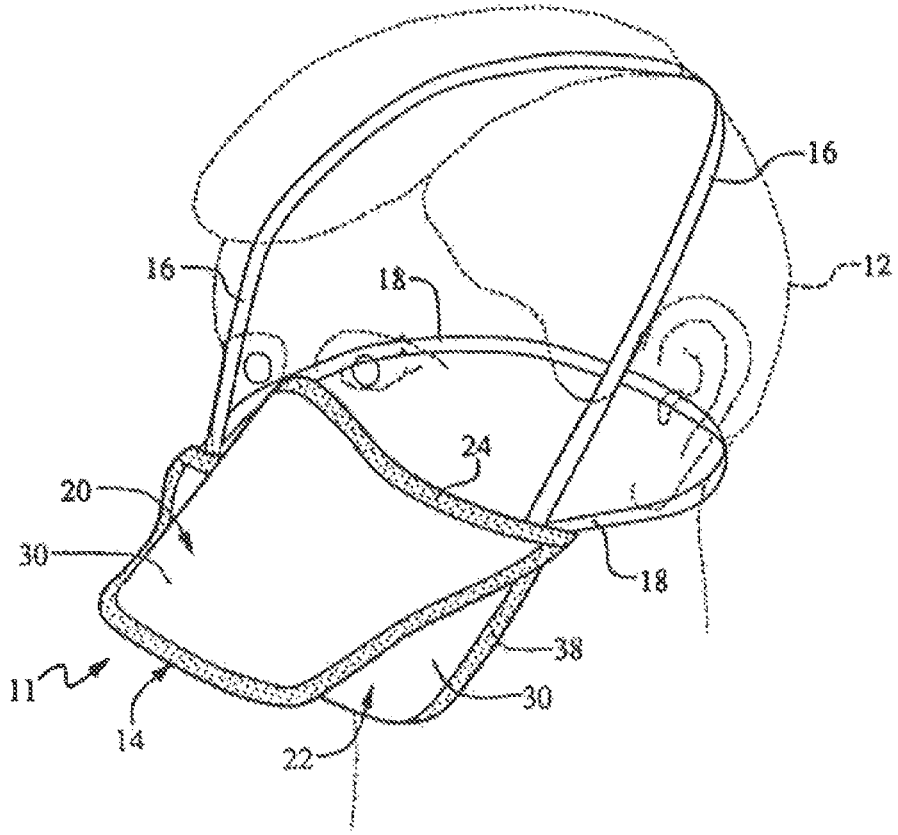
FIG. 1 is a perspective view of a conventional respiratory facemask worn by a user, the facemask incorporating a nose wire to conform the facemask to the user's face.
Figure 2:
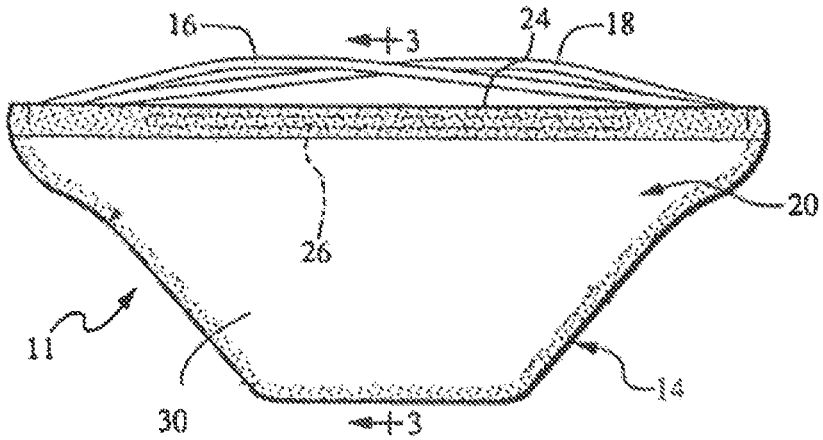
FIG. 2 is a top view of the conventional facemask of FIG. 1 in a folded state.
Figure 3:
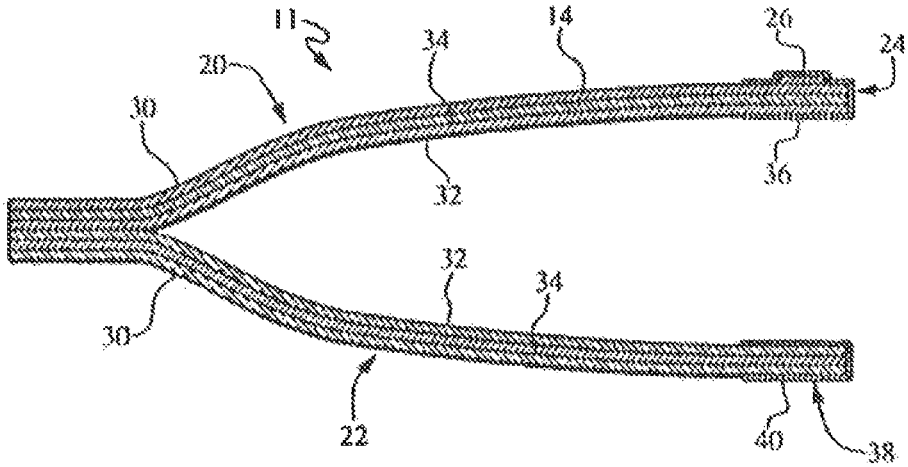
FIG. 3 is a cross-sectional view of the facemask of FIG. 2 taken along the lines indicated in FIG. 2.

Referring to FIGS. 1-3, a representative facemask 11 (e.g., a duckbill facemask) is illustrated on the face of wearer 12. The mask 11 includes filter body 14 that is secured to the wearer 12 by means of resilient and elastic straps or securing members 16 and 18. The filter body 14 includes an upper portion 20 and a lower portion 22, both of which have complimentary trapezoidal shapes and are preferably bonded together such as by heat and/or ultrasonic sealing along three sides. Bonding in this manner adds important structural integrity to mask 11.

The fourth side of the mask 11 is open and includes a top edge 24 and a bottom edge 38, which cooperate with each other to define the periphery of the mask 11 that contacts the wearer's face. The top edge 24 is arranged to receive an elongated malleable member 26 (FIGS. 2 and 3) in the form of a flat metal ribbon or wire (referred to herein as a "nose wire"). The nose wire 26 is provided so that top edge 24 of mask 11 can be configured to closely fit the contours of the nose and cheeks of wearer 12. The nose wire 26 is typically constructed from an aluminum strip with a rectangular cross-section. With the exception of having the nose wire 26 located along top edge 24 of the upper portion 20 of the mask 11, the upper and lower portions 20 and 22 may be identical.

As shown in FIG. 1, the mask 11 has the general shape of a cup or cone when placed on the face of wearer 12 and thus provides "off-the-face" benefits of a molded-cone style mask while still being easy for wearer 12 to carry mask 11 in a pocket prior to use. "Off-the-face" style masks provide a larger breathing chamber as compared to soft, pleated masks which contact a substantial portion of the wearer's face. Therefore, "off-the-face" masks permit cooler and easier breathing.

Blow-by associated with normal breathing of wearer 12 is substantially eliminated by properly selecting the dimension and location of the nose wire 26 with respect to top edge of 24. The nose wire 26 is preferably positioned in the center of top edge 24 and has a length in the range of fifty percent (50%) to seventy percent (70%) of the total length of the top edge 24.

As illustrated in cross-sectional view of FIG. 3, the upper and lower portions 20 and 22 may include multiple layers and each have an outer mask layer 30 and inner mask layer 32. Located between outer and inner mask layers 30, 32 are one or more intermediate filtration layers 34. These layers are typically constructed from a melt-blown polypropylene, extruded polycarbonate, melt-blown polyester, or a melt-blown urethane.

The top edge 24 of the mask 11 is faced with an edge binder 36 that extends across the open end of mask 11 and covers the nose wire 26. Similarly, the bottom edge 38 is encompassed by an edge binder 40. Edge binders 36 and 40 are folded over and bonded to the respective edges 24, 30 after placement of the nose wire 26 along the top edge 24. The edge binders 36, 40 may be constructed from a spun-laced polyester material.

Figure 4:
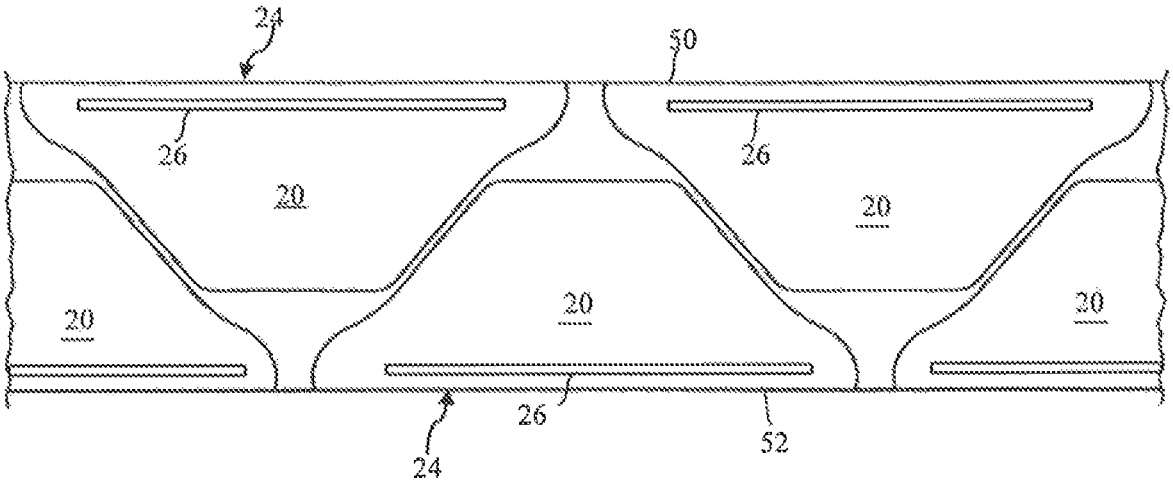
FIG. 4 is a top view of a web having a plurality of facemask panels defined therein, with a nose wire incorporated in edges of alternating panels in the web.

FIG. 4 illustrates the layout of the generally trapezoidal shape for cutting the layers forming the upper body portions 20. A similar layout would be produced for the lower body portion 22, which is then brought into alignment with and bonded to the upper body portion 20 in the facemask manufacturing line. More precisely, the layouts of FIG. 4 represent the outline of cutters which ultimately cut layers 30 and 32 for the upper portion 20 from respective flat sheets of material, with the layouts arranged in an alternating pattern on the flat sheets of material between edges 50, 52 representing the open side of mask 11 formed by top edge 24 and bottom edge 38. The arrangement of the layouts is such that a continuous piece of scrap may be formed as the material is fed through the cutter (not shown) utilized in making mask 11. FIG. 4 illustrates placement of cut nose wires 26 on the portions of the continuous web corresponding to the top edge 24 prior to folding and bonding of the edge binders 36, 40 along the edges 24, 38.

Figure 5:
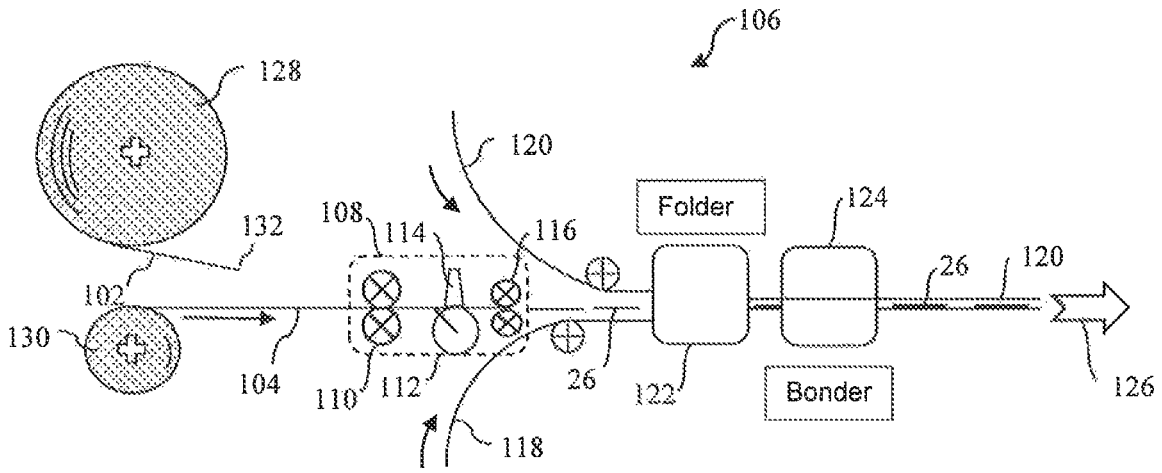
FIG. 5 is a schematic depiction of parts of a facemask production line in accordance with aspects of the invention related to feeding and cutting of nose wires for subsequent incorporation with facemask panels.

FIG. 5 depicts portions of a production line 106 for facemasks that incorporate a nose wire 26. A running nose wire 104 is supplied in continuous strip form from a source, such as a driven operational running roll 130, to a cutting station 108. Suitable cutting stations 108 are known and used in conventional production lines.

The station 108 may include a set of feed rollers 110 that define a driven nip, wherein one of the feed rollers is driven and the other may be an idler roll. The feed rollers 110 may also serve to impart a crimped pattern to the running nose wire, such as diamond pattern. The running nose wire is fed to a cutter roller 112 configured opposite to an anvil 114, wherein the cuter roller 112 is driven at a rate so as to cut the running nose wire 104 into individual nose wires 26. Downstream of the cutter roller 112, a pair of delivery rollers 116 transports the individual nose wires 26 from the cutting station 108 onto a carrier web 118. Referring to FIG. 4, this carrier web 118 may be the continuous multi-layer web that defines the upper body portion 20 wherein the individual nose wires 26 are deposited along the edge of the carrier web 118 corresponding to the top edge 24. It should be appreciated that an additional cutting station may be operationally disposed opposite to (and upstream or downstream) of the cutting station 108 for cutting and placing the nose wires on the opposite nested upper body portions 20 in the web depicted in FIG. 4. For the sake of ease of understanding only one such cutting station is illustrated and described herein.

FIG. 5 also depicts staging of a roll 128 of reserve nose wire 102 having a leading end 132. Upon a predetermined depletion state of the running nose wire 104, the leading end 132 of the reserve nose wire 102 is spliced with the running nose wire 104 without stopping or substantially slowing the overall running speed of the production line 106, as explained in greater detail below with reference to FIGS. 6 through 8.

After placement of the individual nose wires 26 in position on the carrier web 118, the binder web 120 is introduced to the production line along both edges of the carrier web 118 (only one binder web 120 is depicted in FIG. 5.). The combination of carrier web 118, nose wire 26, and binder webs 120 pass through a folding station 122 wherein the binder webs 120 are folded around the respective running edges 50, 52 of the carrier web 118 (FIG. 4). The components then pass through a bonding station wherein the binder webs 120 are thermally bonded to the carrier web 118, thereby producing the edge configurations 24, 38 depicted in FIG. 3 with respective binders 36, 40. The nose wire 26 is held in position relative to the top edge 24 by the binder 36.

From the bonding station 124, the continuous combination of carrier web 118 with nose wires 26 under the binder 36 is conveyed to further downstream processing stations 126 wherein the individual facemasks are cut, bonded, head straps are applied, and so forth.

Figure 6:
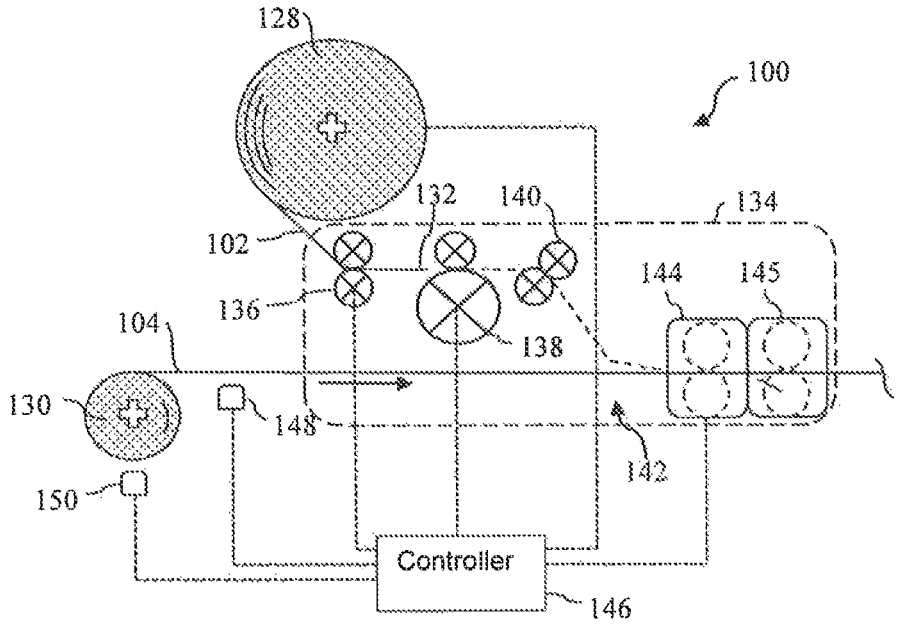
FIG. 6 is a schematic representation of aspects for splicing a reserve nose wire into a running production line in accordance with aspects of the invention.
Figure 7:
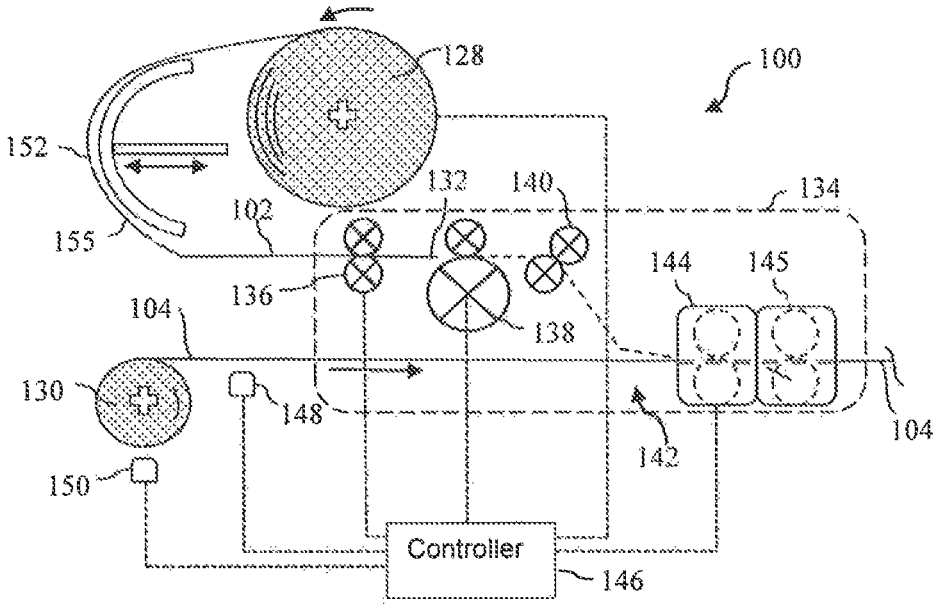
FIG. 7 is a schematic representation of further aspects for splicing a reserve nose wire into a running production line in accordance with aspects of the invention.
Figure 8:
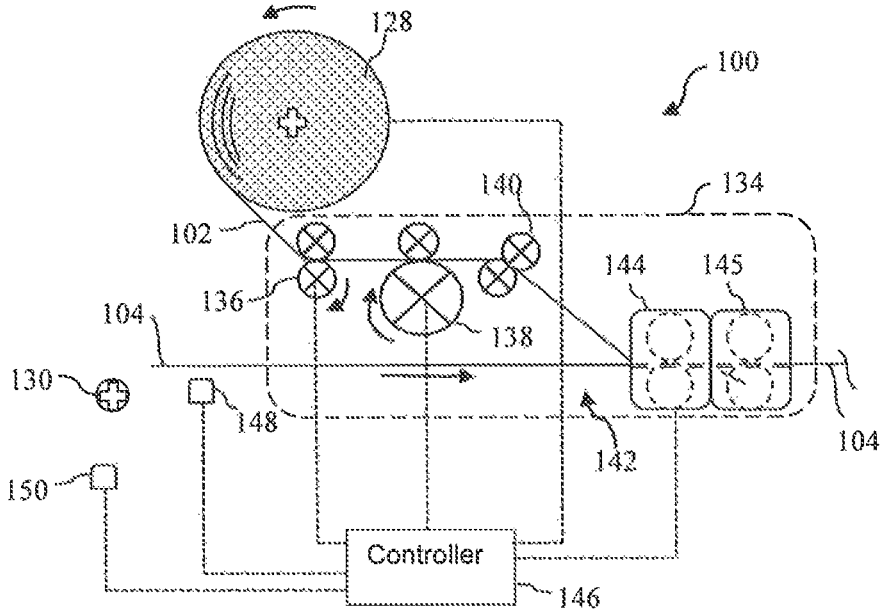
FIG. 8 is a schematic representation of still other aspects for splicing a reserve nose wire into a running production line in accordance with aspects of the invention.

With further reference to FIGS. 6 through 8, aspects of a method 100 are depicted for splicing the leading end 132 of the reserve nose wire 102 (FIG. 5) into the running production line 106 (FIG. 106). FIG. 6 depicts the reserve roll 128 in a stand-by position wherein the leading end 132 of the reserve nose wire 102 has been threaded into a splicing station 142, which may be embodied within a stand-alone cabinet 134. For example, the leading end 132 may be threaded between a first set of feed rollers 136 in the ready or stand-by state. The reserve roll 128 and supply roll 130 are configured with an independent drive, which may be a drive roller or a driven spindle.

The method 100 includes, prior to depletion of the running nose wire 104, bringing the reserve nose wire 102 up to a transport speed in a conveying direction of the running nose wire 104 such that a relative speed of at or near a zero is established between the running nose wire 102 and the reserve nose wire 102. As mentioned above, it should be appreciated that "at or near zero" is intended to encompass some degree of speed deviation so long as such deviation does not prevent a subsequent splicing of the reserve nose wire 102 to the running nose wire 104.

The process of bringing the reserve nose wire 102 up to the desired transport speed for splicing can be done in various ways. For example, referring to FIG. 6, a second, primary set of feed rollers 138 can be brought up to speed prior to introduction of the leading end 132 between the feed rollers 138. So that the feed rollers 138 do not have to "pull" the reserve roll 128 from a standstill to operating speed, the reserve roll 128 can be rotationally driven as the primary feed rollers 138 are coming up to speed, with the leading end 132 of the reserve nose wire clamped between the first set of feed rollers 136. At a time determined by a controller 146, the first set of feed rollers 136 are driven to introduce the leading end 132 to the primary feed rollers 138, which are being driven at a speed to introduce the leading end 132 and continuous reserve nose wire 104 through diverter rollers 140 (driven or idle rollers) and onto the running nose wire 104 at the desired minimal relative speed between the running wires 102, 104 discussed above.

The controller 146 may be any configuration of control hardware and software to control the individual drives of the reserve roll 128, first set of feed rollers 136, and primary feed rollers 138 in the sequence discussed above.

FIG. 7 depicts an aspect of the method 100 wherein the reserve roll 128 is driven while the leading end 132 of the reserve nose wire 102 is clamped between the first set of feed rollers 136 in order to create an accumulation 152 of the reserve nose wire 102 that can be drawn down once the feed rollers 136 and 138 are engaged to deliver the reserve nose wire 102 at transport speed to the running nose wire 104 as the reserve roll 128 is being brought up to an operational speed. These functions can also be initiated and controlled by the controller 146. The accumulation 152 is depicted in FIG. 7 as a single loop that does not overlap or fold, but essentially grows in a direction away from the reserve roll 128. Forming the accumulation 152 in a wire presents unique considerations. Unlike a flexible web, such as a paper or nonwoven web, the accumulation 152 is susceptible to creasing, kinking, or twisting if the accumulation 152 were formed as overlapping folds. To allow the accumulation 152 to grow, without twisting, it may be desired to utilize a mechanical guide arm, rail, channel, or similar structure 155 that engages the wire as the accumulation 152 grows. This guide structure 155 may be mounted to traverse in the direction of the growing accumulation 152, as depicted by the arrows in FIG. 7. The structure 155 may be open (e.g., a C-channel) or closed (e.g., a tube), and prevents the wire from twisting or kinking.

Referring to FIG. 8, after the leading end 132 has been introduced to the running wire 104 at the desired relative speed of at or near zero, the two nose wires 102, 104 are spliced together at the splicing station 142. Various splicing means may be employed, including adhesive application, spot welding/tacking, and so forth. In a certain embodiment, the splicing process is performed at the station 142 by crimping the reserve nose wire 102 onto the running nose wire 104 with crimper rollers 144. These crimper rollers 144 are also controlled by the controller 146 to crimp the leading end 132 to the running nose wire 104, for example with a clamp or other known splicing devices.

After the splice, the running nose wire 104 is cut. In the embodiment of FIG. 8, this cut may be made by a cutter roll 145 downstream of the crimper rollers 144, wherein one of the rollers 145 includes a cutting blade that cuts through the bottom running wire 104 without cutting through the top running reserve wire 102.

After the splicing process at station 142, the reserve roll 128 can be moved to an in-line operating position (e.g., the position of the running roll 130 in FIG. 5), and a new reserve roll can be staged for a subsequent splice operation. Alternately, the reserve roll 128 can become the operational roll without being relocated, and the new reserve roll can be staged at the location of the previous running roll 130.

As mentioned, the splice can be performed with a portable splice cabinet 134 that is brought into position alongside of the production line 106 functionally between the reserve roll 128 and the running nose wire 104. After the splice is complete, the splice cabinet 134 can be functionally disengaged from the production line 106 and moved to another location or different production line 106. In an alternative embodiment, the splice is performed by splice machinery that is permanently configured with the production line.

Various controls and associated sensors may be utilized to accomplish the splicing process. For example, in FIGS. 6 through 8, the transport speed of the running nose wire 104 is sensed by a sensor 148 in communication with controller 146 and, based on this running speed and a distance of the leading end 132 of the reserve nose wire 132 from a splicing location, the controller 146 can control the drives of the reserve roll 128 and feed roller pairs 136, 138 such that the reserve nose wire 102 can be brought up to the transport speed to achieve the at or near zero relative speed between the reserve nose wire 102 and the running nose wire 104 necessary for the splice.

In order to properly time the splice, certain embodiments may include sensing a depletion state of the running nose wire 104 and timing the splicing as a function of the sensed depletion state. For example, at a given sensed diameter of the running roll 130 determined by a sensor 150 in communication with the controller 146, the splice sequence can be initiated at a defined depletion state of the running wire 104.

As mentioned, the present invention also encompasses various system embodiments for splicing a reserve nose wire to a running nose wire in a facemask production line in accordance with the present methods. Aspects of such systems are illustrated in the figures, and described and supported above.

The material particularly shown and described above is not meant to be limiting, but instead serves to show and teach various exemplary implementations of the present subject matter. As set forth in the attached claims, the scope of the present invention includes both combinations and sub-combinations of various features discussed herein, along with such variations and modifications as would occur to a person of skill in the art.

What is claimed is:

1. A method for splicing a reserve nose wire to a running nose wire in a facemask production line, comprising:

prior to depletion of the running nose wire, bringing the reserve nose wire up to a transport speed in a conveying direction of the running nose wire;

at a relative speed between the running nose wire and the reserve nose wire that allows a subsequent splicing process, introducing a leading end of the reserve nose wire onto the running nose wire and forming a splice between the reserve nose wire and the running nose wire;

cutting the running nose wire upstream of the splice location such that the reserve nose wire becomes a new running nose wire in the production line;

the reserve nose wire supplied from a reserve roll of nose wire;

wherein the reserve roll is driven prior to introducing the leading end of the reserve nose wire onto the running nose wire to create an initial accumulation of the reserve nose wire that is drawn down as the reserve roll comes up to an operating rotational speed.

2. The method as in claim 1, wherein the leading end of the reserve nose wire is staged at a location for subsequent feeding onto the running nose wire at the relative speed.

3. The method as in claim 2, wherein one or more feed rollers draw the leading end of the reserve nose wire from the reserve roll and onto the running nose wire.

4. The method as in claim 2, wherein the reserve roll is moved to an in-line operating position after the splice, and a new reserve roll is staged for a subsequent splice operation.

5. The method as in claim 1, further comprising sensing transport speed of the running nose wire and, based on the running speed and distance of the leading end of the reserve wire from a crimping location, bringing the reserve nose wire up to the transport speed to achieve the relative speed between the reserve nose wire and the running nose wire.

6. The method as in claim 5, further comprising sensing a depletion state of the running nose wire and timing the splicing as a function of the sensed depletion state.

7. The method as in claim 1, wherein the splice is performed by crimping the reserve nose wire to the running nose wire.

8. The method as in claim 1, wherein the splice is performed with a portable splice cabinet that is brought into position alongside of the production line.

9. The method as in claim 1, wherein the splice is performed by splice machinery that is permanently configured with the production line.

* * * * *